United States Patent [19]

Van Den Essen

[11] 4,118,128

[45] Oct. 3, 1978

[54] OPTICAL TYPEWRITER

[76] Inventor: Louis Van Den Essen, 131 E. Riviera Dr., Lindenhurst, N.Y. 11757

[21] Appl. No.: 611,494

[22] Filed: Sep. 8, 1975

[51] Int. Cl.[2] ..... B41J 3/20

[52] U.S. Cl. ..... 400/118; 178/15; 346/76 L

[58] Field of Search ..... 197/1 R; 346/76 L, 108; 178/6.6 R, 6.7 R, 15

[56] References Cited

U.S. PATENT DOCUMENTS

| | | | |
|---|---|---|---|
| 2,929,294 | 3/1960 | Kardas et al. | 346/108 X |
| 3,287,736 | 11/1966 | Germer | 346/76 L |
| 3,570,380 | 3/1971 | Kamenstein | 346/76 L |
| 3,842,195 | 10/1974 | Takahashi et al. | 346/76 L X |
| 3,907,089 | 9/1975 | Montoya | 197/1 R |

FOREIGN PATENT DOCUMENTS

| | | | |
|---|---|---|---|
| 1,502,044 | 10/1966 | France | 197/1 R |
| 2,034,435 | 1/1972 | Fed. Rep. of Germany | 197/1 R |
| 1,447,915 | 4/1969 | Fed. Rep. of Germany | 197/1 R |
| 2,115,919 | 10/1971 | Fed. Rep. of Germany | 197/1 R |
| 1,436,741 | 5/1969 | Fed. Rep. of Germany | 197/1 R |

*Primary Examiner*—Paul T. Sewell

[57] ABSTRACT

A typewriter for writing with a light beam on a photosensitive paper includes a translatable typewriter carriage having a sight carried fixedly to a frame of the typewriter defining a region on which an indicia is being written. A light source is carried on a servo-driven trolley along an arcuate track having a center of curvature at the sight portion. A perforate letter template is located along a coaxial arc between the track and the carriage. In response to the depression of a key on a keyboard, for selecting a letter to be typed, the trolley is positioned along the track so that the light therefrom passes through a selected indicia on the template and then to the sight defined region of the paper.

1 Claim, 3 Drawing Figures

FIG. 1
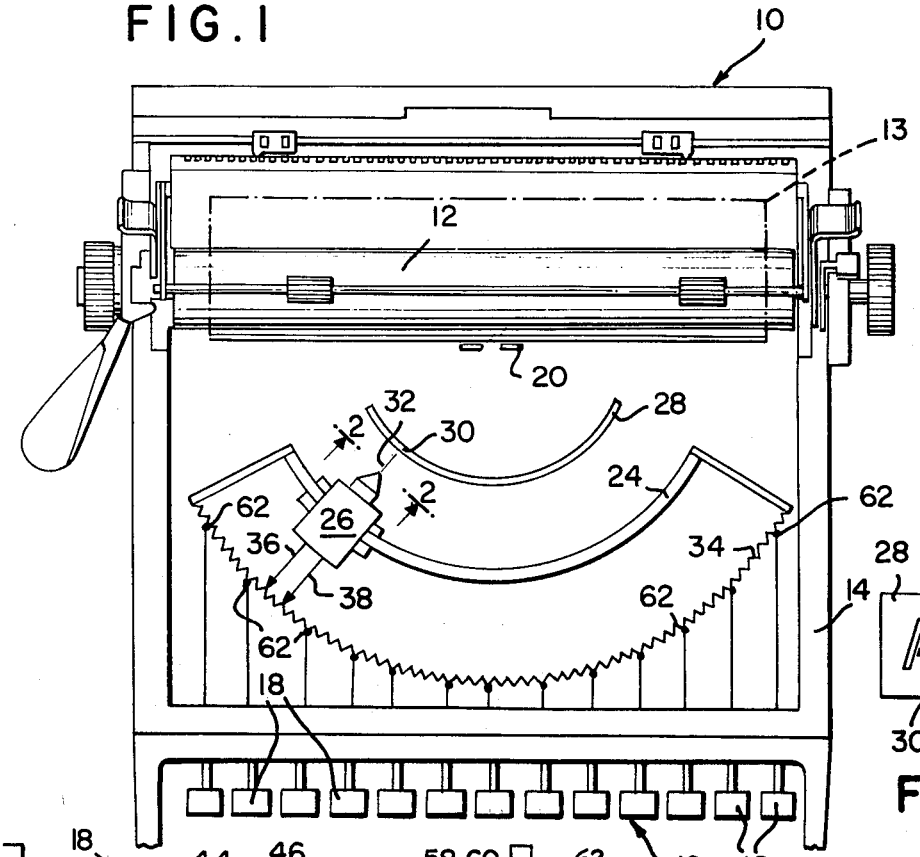
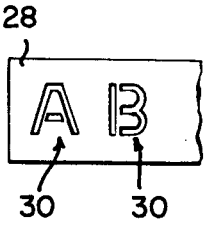
FIG. 2
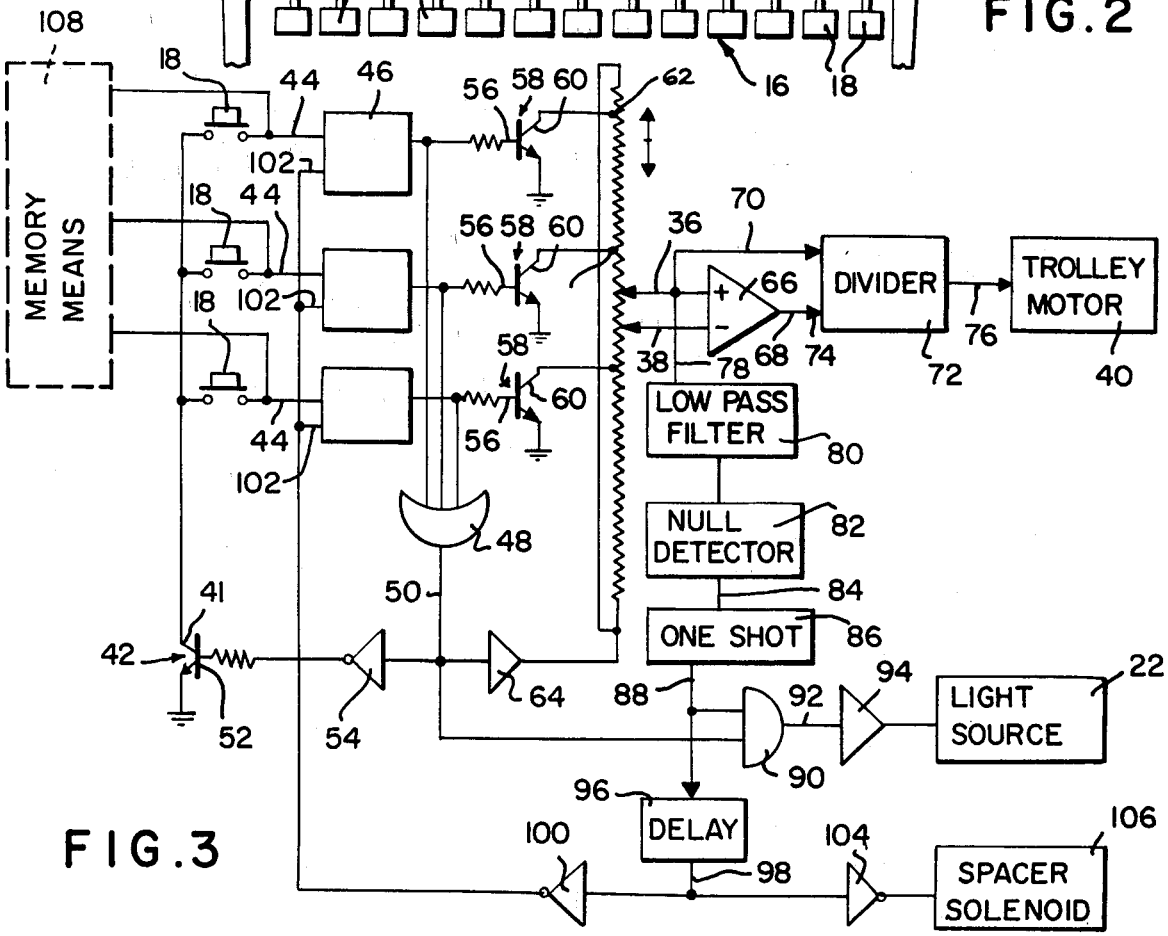
FIG. 3

OPTICAL TYPEWRITER

FIELD OF THE INVENTION

The present invention relates generally to writing machines. In its particular aspects, the present invention relates to a writing machine in which a light source is positioned to direct light through different ones of perforate indicia in response to the actuation of keys on a keyboard.

BACKGROUND OF THE INVENTION

In the conventional typewriter, a considerable amount of noise is caused by the keys striking the platen, and from other noises arising from the operation of the machine. While there have been attempts in the prior art to fashion a carriage roller platen of noise absorbing material such attempts have not been entirely successful. If a light source could be utilized to form images on a photosensitive paper, considerable noise could be eliminated.

It has been known in the prior art to direct a beam of light onto photosensitive paper to trace graphs thereon. Applicant is aware of no prior art where the orientation of a light source is controlled by a keyboard for selectively passing light through different perforate indicia and then onto a photosensitive paper.

OBJECTS OF THE INVENTION

It is an object of the present invention to provide an optical typewriter capable of producing letters on a photosensitive paper in response to a standard keyboard.

It is a further object of the present invention to provide a substantially silent typewriter.

SUMMARY OF THE INVENTION

Briefly, the aforementioned and other objects of the present invention are satisfied by providing a curved track having a center of curvature at the sight portion of a standard translatable typewriter carriage. An elongated curved template is provided coaxial with the track and has angularly spaced perforate indicia thereon. A motorized trolley ride along the track and carries a directional light source aimed normal to the track such that light is passed through the indicia and onto photo-sensitive paper positioned on the carriage to form the indicia on the paper. Each angular position along the track corresponds to the light passing through a different indicia on the template.

A potentiometer is strung along the track and the keys of a standard electric keyboard are coupled for applying ground potential to corresponding points along the track.

The trolley carries a pair of spaced wipers engaging the potentiometer for picking up suitable servomechanism control signals for guiding the trolley to the grounded position on the track.

When the trolley reaches the aforementioned position, the light source is pulse energized to pass light through the selected indicia and onto the paper.

Other objects, features and advantages of the present invention will become apparent upon perusal of the following detailed description of the preferred embodiment thereof when taken in conjunction with the appended drawing wherein:

FIG. 1 is a plan view of the optical typewriter of the present invention;

FIG. 2 is a partial cross-sectional view along the lines 2—2 in FIG. 1; and

FIG. 3 is an electrical schematic for the optical typewriter of the present invention.

DETAILED DESCRIPTION

Referring first to FIGS. 1 and 2 of the drawing the optical typewriter of the present invention is generally indicated by the reference numeral 10. Typewriter 10 includes a standard translatable paper carriage or platen 12 which retains a photo-sensitive sheet of paper 13. Paper 13 may be photosensitive in the sense that it is chemically treated to darken upon an intense light impinging thereon or may be photo-sensitive in the sense that the paper will char due to the heat created by the intense light.

The carriage 12 is retained at one end of a typewriter frame 14, while a standardly arranged electric typewriter keyboard 16 is formed at the other end of frame 14. Each key 18 of the keyboard 16 is depressed to select a different letter indicia to be formed on paper 13 between the upstanding legs of a sight 20 positioned in front of carriage 12 in the center of frame 14 fixed in relation to the direction of translation of the carriage.

In accordance with the principles of the present invention, rather than striking the paper within sight 20 through an inked ribbon with keys, letter indicia are optically formed thereon from a lazer light source 22 which causes the paper to darken where illuminated.

A curved track 24 is provided between carriage 12 and keyboard 16. The track has a center of curvature located between the legs of sight 20. A motorized trolley 26 rides along track 24 and carries the light source 22 pointing radially of the track toward sight 20. Between track 24 and carriage 12 is located an opaque template strip 28, also shown in FIG. 2. Strip 28 is curved to be coaxial with track 24. Perforate letter indicia 30 on the strip 28 are angularly spaced apart along the strip so that trolley 26 must be located in a corresponding angular position along track 24 to select a particular indicia 30 for the light beam 32 from source 22 to pass through prior to impinging on the paper 14 between the legs of sight 20.

It will be apparent to those skilled in the art the light beam 30 when it reaches strip 28 must be of a cross-sectional diameter to encompass an indicia 30 so that the beam, upon exiting the strip 28, will be formed in cross-section in accordance with the shape of any selected one of the indicia 30.

The motorized trolley 26 is driven along track 24 to selected angular positions by a servo-mechanism system responsive to keyboard 16, which will be understood by reference to FIGS. 1 and 3.

A resistance wire 34 is directed along track 24 and is engaged by a pair of constantly spaced apart wipers 36 and 38 which pick up control signals to feed the motor 40 of trolley 26. To understand how the trolley motor 40 will drive trolley 26 to a desired angular orientation, it is necessary to first understand how resistance wire 34 is excited in response to keyboard 16.

Each key 18 comprises a momentary contact switch connected between the collector 41 of an emitter grounded NPN transistor switch 42 and the set input 44 of an associated different flip-flop 46. The "Q" output of each flip-flop is connected to a different input of an OR gate 48. Thus the output 50 of gate 48 has a digital one state if any flip-flop 46 is set. Output 50 is fed to the base 52 of transistor switch 42 via an inverter 54 in a manner for a digital one state on line 50 to turn switch 42 off. Since a flip-flop 46 may only be set if transistor switch 42 is closed, it should be apparent that the depression of any particular key 18 will set the associated flip-flop 45 and the setting of any other flip-flop will be prevented until that flip-flop is reset.

Further the "Q" outputs of each flip-flop 46 are coupled to the base 56 of an associated different grounded emitter NPN transistor switch 58. The collector 60 of each transistor switch 58 is connected to a different point 62 along resistance wire 34, each point 62 corresponding to the angular location along track 24 at which trolley 26 should be located for light beam 32 to pass through the particular indicia 30 corresponding with the associated key 18. Thus, it should be apparent that a particular point 62 along resistance wire 34 is grounded, via the associated transistor 58, to indicate the angular location where the trolley is to be positioned.

It should be apparent to those skilled in the art, that the output 50 is zero volts in the digital zero state and is some non-zero voltage, such as five volts in the digital one state. Output 50 is fed via an amplifier 64 to both ends of resistance wire 34 to energize the opposite ends thereof when a flip-flop 46 is set.

With the opposite ends of the resistance wire 34 being energized with a D.C. voltage and a particular point being grounded along the wire, the trolley 26 may be properly positioned with wiper 36 at the grounded point. To this end the wipers 36 and 38 are connected to the bipolar inputs of a differential amplifier 66. It should be apparent that the output 68 of amplifier 66 has a sign or polarity indicative of which direction the motor 42 should be driven to reach the grounded point 62. The amplitude of output 38 is also indicative of a servomechanism gain. By connecting wiper 36 to a numerator input 80 of an analog division network 72, and connecting the output 68 to the denominator input 74 thereof, the output 76 of divider 72 is a properly conditioned error signal sufficient to drive motor 40.

The trolley 26 will carry wiper 36 to the grounded one of points 62 and then stop. To determine when the trolley is properly positioned along the desired indicia, wiper 36 is connected to the input 78 of a low pass filter 80, to reject transient oscillations of the trolley 26 about the desired position. The output of filter 80 is fed to a null detector 82, such as a window comparator, which has a digital zero output on line 84 when wiper 36 is not at zero volts and a digital one output when wiper 36 is at zero volts.

A one-shot 86 is provided fed from line 84 which produces a pulse at its output 88 initiated by a digital zero to digital one state transition on line 84. Thus a pulse is fired on line 88 just as the trolley 26 comes to rest at the desired location along track 24.

Output 50 of OR gate 48, as well as line 88 provide the two inputs to an AND gate 90 whose output 92 will also have the pulse on line 88, providing line 50 has a digital-one state, which is the case if one of flip-flops 46 is set. Output 92 is fed via buffer amplifier 94 to pulse energize light source 22. The pulse width of one shot 86 is chosen to equal the time necessary to expose the paper 14 to light beam 32 in order to create a darkened image as by thermal charring or chemical reaction.

Line 88 is also fed to a time delay 96 longer than the pulse width of one-shot 86. The output 98 of delay 96 thus has a pulse after the light source 22 has completed its work and been turned off. Output 98 is fed via an inverter 100 to the reset inputs 102 of each flip-flop 46 to reset the particular flip-flop which had been set and enable the keys 18 to be effective for the selection of a new indicia.

Furthr output 98 is fed via a buffer amplifier 104 to a solenoid 106 for advancing carriage 12 one space in a conventional manner.

It should be appreciated that the optical typewriter 10 may be interfaced with a memory means 108 such as a magnetic card reader and recorder in a conventional manner by connection with the keys 18 providing a highly efficient and quiet automatic machine.

While the present invention has been described and illustrated in particular detail, it should be understood that many aspects of such details are illustrative in nature. Consequently, numerous modifications, additions and omissions in the details thereof are possible within the intended spirit and scope of the invention claimed herein.

What is claimed is:

1. A writing machine comprising a translatable paper carriage for holding a light sensitive paper; a fixedly positioned sight alongside said carriage for defining a portion of said paper to be written on; an elongated track directed along a first arc swung about said sight; an elongated template lying along a second arc located between said sight and said track, said second arc also being swung about said sight; said template having a plurality of perforate indicia thereon; said indicia being spaced apart along the length of said template; a directional light source mounted for movement along said track; said light source being aimed toward said sight for directing light through a selected one of said indicia and onto said paper; there being a correspondence between the selected indicia and the position of said light source along said track; a keyboard for selecting which of said indicia is to be written on said paper; and motor means responsive to said keyboard for positioning said light source along said track.

* * * * *